US009457534B2

(12) United States Patent
Avedissian

(10) Patent No.: US 9,457,534 B2
(45) Date of Patent: Oct. 4, 2016

(54) BAGS AND METHOD OF MAKING BAGS INCORPORATING REPURPOSED SIGN MATERIAL

(71) Applicant: Rareform LLC, Camarillo, CA (US)

(72) Inventor: Alec Avedissian, Camarillo, CA (US)

(73) Assignee: Rareform LLC, Camarillo, CA (US)

( * ) Notice: Subject to any disclaimer, the term of this patent is extended or adjusted under 35 U.S.C. 154(b) by 119 days.

(21) Appl. No.: 14/221,025

(22) Filed: Mar. 20, 2014

(65) Prior Publication Data

US 2014/0205217 A1 Jul. 24, 2014

Related U.S. Application Data

(63) Continuation-in-part of application No. 13/685,837, filed on Nov. 27, 2012, now abandoned.

(60) Provisional application No. 61/693,660, filed on Aug. 27, 2012.

(51) Int. Cl.

| | |
|---|---|
| ***A45C 3/00*** | (2006.01) |
| ***B31B 19/16*** | (2006.01) |
| ***A45C 13/08*** | (2006.01) |
| ***A45C 3/02*** | (2006.01) |
| ***A45F 3/04*** | (2006.01) |

(52) U.S. Cl.

CPC ..... *B31B 19/16* (2013.01); *A45C 3/001* (2013.01); *A45C 3/02* (2013.01); *A45C 13/08* (2013.01); *A45F 3/04* (2013.01)

(58) Field of Classification Search

CPC ..... B31B 19/16; B31B 21/00; B31B 2219/9045; B31B 2221/10; A45C 3/001; A45C 3/02; A45C 13/08; A45F 3/04

USPC ..... 493/344, 343, 259

See application file for complete search history.

(56) References Cited

U.S. PATENT DOCUMENTS

| | | | | | |
|---|---|---|---|---|---|
| 2,418,589 | A * | 4/1947 | Lifton | A45C 3/00 | 190/111 |
| 3,067,652 | A * | 12/1962 | Cross | B42D 5/04 | 40/788 |
| 3,115,959 | A * | 12/1963 | Jaffe | A45C 3/004 | 190/113 |
| 3,399,099 | A * | 8/1968 | Kent | B65B 51/06 | 156/479 |
| 3,412,655 | A * | 11/1968 | Kranz | B31B 21/00 | 156/514 |
| 4,210,186 | A | 7/1980 | Belenson | | |
| 4,410,578 | A * | 10/1983 | Miller | B32B 3/12 | 206/204 |
| 4,455,809 | A * | 6/1984 | Dallaserra | B31B 41/00 | 229/69 |
| 4,515,300 | A * | 5/1985 | Cohen | A45C 1/04 | 224/153 |
| 4,756,939 | A * | 7/1988 | Goodwin | B65D 81/264 | 206/204 |
| 4,790,051 | A * | 12/1988 | Knight | A61G 1/01 | 27/28 |

(Continued)

OTHER PUBLICATIONS

"Beach Bag", Billboard Ecology, Jun. 2012, http://web.archive.org/web/20120624010830/http://www.billboardecology.com/Details.cfm?ProdID=38&category=2.

(Continued)

*Primary Examiner* — Sameh Tawfik

(74) *Attorney, Agent, or Firm* — Fish & Tsang LLP

(57) ABSTRACT

Bags and methods of manufacturing bags including a combination of repurposed material and virgin material in significant visible portions are described. The repurposed material can advantageously comprise a billboard material that may otherwise be thought of as waste or trash, which can be used to manufacture unique bags in combination with any suitable virgin materials having properties or qualities that are optimal for a given use or purpose.

6 Claims, 3 Drawing Sheets

(56) References Cited

U.S. PATENT DOCUMENTS

| | | | | |
|---|---|---|---|---|
| 5,117,610 | A * | 6/1992 | Hartman | B31B 41/00 101/490 |
| 5,294,042 | A * | 3/1994 | Giordano | B41L 1/32 229/69 |
| 5,405,002 | A * | 4/1995 | Troia | B63C 13/00 206/315.1 |
| 5,413,199 | A | 5/1995 | Clement | |
| 5,476,184 | A | 12/1995 | Hill | |
| 5,538,137 | A | 7/1996 | Deloma et al. | |
| 5,615,769 | A | 4/1997 | Stephenson | |
| 5,649,708 | A * | 7/1997 | Podlesny | F41J 3/0004 273/403 |
| 5,794,747 | A | 8/1998 | Bryant | |
| 5,881,708 | A * | 3/1999 | Kliot | A43B 5/0425 224/582 |
| 5,893,504 | A * | 4/1999 | Baronian | A45F 3/04 224/627 |
| 5,934,533 | A * | 8/1999 | Callanan | A45F 3/04 224/250 |
| 6,004,034 | A * | 12/1999 | Salam | A61G 17/06 27/28 |
| 6,039,474 | A * | 3/2000 | DeChant | A45C 3/00 190/109 |
| 6,234,944 | B1 * | 5/2001 | Anderson | B65D 81/264 156/270 |
| 6,290,114 | B1 * | 9/2001 | Berberian | A45F 3/04 224/637 |
| 6,382,376 | B1 | 5/2002 | Rosen et al. | |
| 6,561,329 | B2 * | 5/2003 | Stobbs, II | A45C 3/00 190/107 |
| 6,866,620 | B2 * | 3/2005 | Friedman | B31B 23/00 493/210 |
| 7,338,210 | B1 | 3/2008 | Fultz et al. | |
| 7,496,995 | B2 * | 3/2009 | Rosario | A01N 1/00 220/89.1 |
| 7,568,599 | B2 * | 8/2009 | Hall | A45F 3/10 224/250 |
| 7,654,426 | B2 * | 2/2010 | Eberle | A45F 3/04 224/637 |
| 7,807,008 | B2 * | 10/2010 | Nethers, II | B29B 17/0042 156/153 |
| 8,586,161 | B2 * | 11/2013 | Tamber | B29B 17/0042 428/35.2 |
| 8,637,129 | B2 * | 1/2014 | Withers | B29C 47/0021 428/34.4 |
| 9,039,590 | B2 * | 5/2015 | Daughtry | B65D 33/02 493/189 |
| 2002/0104725 | A1 | 8/2002 | Dexheimer | |
| 2002/0148741 | A1 * | 10/2002 | Stobbs | A45C 3/00 206/112 |
| 2003/0223651 | A1 * | 12/2003 | Weleczki | A45C 7/0077 383/4 |
| 2006/0006634 | A1 | 1/2006 | Packer | |
| 2007/0183689 | A1 | 8/2007 | Leone et al. | |
| 2008/0260301 | A1 | 10/2008 | Winter | |
| 2010/0006469 | A1 * | 1/2010 | Allouche | B63B 35/7946 206/523 |
| 2010/0213020 | A1 | 8/2010 | Lynch-Ringvold | |
| 2012/0188743 | A1 * | 7/2012 | Wilson | G06F 3/041 361/816 |
| 2013/0036986 | A1 * | 2/2013 | Callari | A01K 15/025 119/702 |
| 2013/0331250 | A1 * | 12/2013 | Coulombe | A61F 13/15593 493/344 |

OTHER PUBLICATIONS

Foss, J., "Green Guru Gear by Ecologic Designs", MetroHippie, Jan. 1, 2008, http://www.metrohippie.com/green-guru-gear-by-ecologic-designs/.

"Fundamentals Collection", Freitag, http://www.freitag.ch/Fundamentals-line/c/Fundamentals, screen capture Mar. 14, 2014.

Gorilla Sacks, May 2012, http://web.archive.org/web/20120520033045/http://www.gorillasacks.com/pages/Custom-Corporate.html.

Green with Envy, Jun. 2009, http://web.archive.org/web/200906020934 54lhttp :llwww.greenwithenvygifts.com/purses-billboard -purses---totes.html.

Meyers, G., "Recycling Billboard Vinyl as a Building Tarp", Green Building Elements, posted Jan. 31, 2011, http://greenbuildingelements.com/2011/01/31/recycling-billboard-vinyl-as-a-building-tarp/, screen capture Nov. 13, 2012.

"Black Hole Messenger", Patagonia, http://www.zappos.com/patagonia-black-hole-messenger-black?zlfid=191&ref=pd__sims__sdp__1.

Stanley, T.L., "Hollywood studios taking a shine to the billboards-to-bags idea", BrandFreak.com, posted Jan. 29, 2010, http://www.brandfreak.com/2010/01/hollywood-studios-taking-a-shine-to-the-billboardstobags-idea.html, screen capture Nov. 13, 2012.

"Yak Pak Billboard Messenger Bag", TerraCycle, http://www.terracycle.com/en-US/products/yak-pak-billboard-messenger-bag.html, screen capture Nov. 27, 2012.

"Denim and Recycled Rubber Tire Bag", Taraluna, http://www.taraluna.com/Merchant2/merchant.mvc?Screen=PROD&Product__Code=011233&Category__Code=, screen capture Mar. 11, 2014.

"Vaho Projects", Vaho, http://vaho.ws/en/proyectos, screen capture Nov. 27, 2012.

Vaho Bags, http://vaho.ws/bags, screen capture Mar. 14, 2014.

Wong, E., "Old billboard vinyl is now being recycled into groovy new bags", BrandFreak.com, posted Jan. 12, 2012, http://www.brandfreak.com/2010/01/old-billboard-vinyl-is-now-being-recycled-into-groovy-new-bags.html, screen capture Nov. 13, 2012.

* cited by examiner

BAGS AND METHOD OF MAKING BAGS INCORPORATING REPURPOSED SIGN MATERIAL

This application is a continuation-in-part of U.S. patent application Ser. No. 13/685,837, filed on Nov. 27, 2012, which claims the benefit of priority to U.S. Provisional Application No. 61/693,660, filed on Aug. 27, 2012. This and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention is repurposing technologies.

BACKGROUND

The background description includes information that may be useful in understanding the present invention. It is not an admission that any of the information provided herein is prior art or relevant to the presently claimed invention, or that any publication specifically or implicitly referenced is prior art.

Various companies have put forth effort in utilizing materials from existing items for new purposes. Vaho Works, Ecologic Designs and Freitag Lab, as examples, are eco-design companies that offer messenger bags and wallets that are made entirely or almost entirely from a single type of repurposed material (e.g., advertisement banners, truck tarpaulins or inner tubes). Other companies have put forth effort in providing bags that are made entirely or almost entirely from a combination of repurposed tire and denim material. Because these companies appear to each market their products as being environmentally friendly, nature friendly or green, they are heavily incentivized to provide products made entirely of repurposed or at least environmentally friendly materials. Viewed from another perspective, a PHOSITA would not think to make bags of both repurposed materials and significant amounts of virgin material because (1) they would lose the marketing advantage, and (2) doing so is more expensive because it generally requires at least one of careful design selections and hand-cutting.

Some efforts have even been put forth in providing bags made from rubber tire material (side portions) and hemp material (front and back portions). As hemp is a popular material among environmental enthusiasts (being generally known as versatile and suitable for uses such as electric cars, paper, oils, clothing, etc.), and tire material does not include significant design elements to consider when cutting or designing products, many identical or almost identical tire/hemp bags can easily be manufactured, and retain the benefit of green marketing efforts.

Unfortunately, no one appears to have appreciated that repurposed materials can be more optimally used for their unique design elements and tear/weather resistant qualities, for example, using a repurposed billboard material for its water-resistant qualities in a bag that also includes a more visually appealing virgin material.

Thus, there is still a need for improved apparatuses, systems and methods of making products incorporating repurposed materials.

SUMMARY OF THE INVENTION

The inventive subject matter provides apparatus, systems and methods in which a bag comprises repurposed (e.g., recycled or upcycled) sign material or other material including a decorative portion (e.g., an advertisement, an image, text, a trademark, or a copyrighted work, etc. printed or otherwise incorporated thereon). The bag could be of any suitable size and shape (e.g., a tote bag, a satchel, a backpack, a surfboard or other water board bag, a crossbody bag, a messenger bag, a laptop bag, etc.), and include any suitable number of fasteners, straps, handles, pockets and other features (e.g., 1, 2, 3, 4, 5, 10, etc.). As used herein, the term "repurposed material" means a material that was previously used for one purpose, and is now being used for a different purpose and in a non-related medium from its original purpose and creation (e.g., a first purpose as an advertisement and a second purpose as a carrier, etc.). Repurposed materials include recycled materials (i.e., ones that reprocessed (e.g., aluminum is melted, removing ink from papers, etc.) between first and second purposes or uses), and upcycled materials (i.e., ones that maintain the same form (e.g., billboard signs, tires, bottle caps, etc. that are not processed other than being washed or cut)).

In some aspects of the inventive subject matter, a contemplated bag, carrier or other product (e.g., clothing, wallets, coverings, etc.) includes a dominant portion of a bag (e.g., a front or other most visible portion of a bag when used or worn) that comprises significant portions of at least two different materials, including (i) a decorative portion of a sign material having a desired design, and (ii) a portion of an at least partially virgin material (i.e., partially or entirely virgin material). Alternatively or additionally, a bag can include significant portions (i) an eco-friendly material, and (ii) at least one of a non-eco friendly material and an at least partially virgin material. It is contemplated that an outer layer (e.g., an outer surface area of an exterior portion or layer) of a bag can comprise at least 10%, at least 15%, at least 25%, or even at least 45% of each of a sign material (or other eco-friendly material) and an at least partially virgin material (or a non-eco material). Viewed from another perspective, it is contemplated that a front portion (i.e., a non-side and non-back portion of a bag that is viewable to a passerby when the bag is worn by a wearer) could comprise at least 10%, at least 15%, at least 25%, or even at least 45% of each of a sign material (or other eco-friendly material) and an at least partially virgin material (or a non-eco material). Viewed from another perspective, it is contemplated that one or more of an outer layer of a bag and a front portion of a bag can be made of less than or equal to 65%, less than or equal to 50%, or even less than or equal to 35% of a sign material.

As used herein, the term "decorative portion of a sign material" refers to a portion of a sign having decorative features such as, for example, an image, a color scheme, a pattern, a design, a text or portions thereof that is selected by an entity that is being promoted or advertised by the sign material. It is contemplated that a decorative portion of a sign material that is used in an outer layer or a front portion of a bag could be or any suitable size and dimension. For example, a decorative portion used in an outer layer or a front portion of a bag could be less than 20 inches in length and less than 12 inches in width, or even less than 15 inches in length and less than 5 inches in width. In other embodiments, the decorative portion could be less than 10 inches in length, more than 20 inches in length, more than 30 inches in length, or even more than 40 inches in length. Additionally or alternatively, the decorative portion could be less than 3 inches in width, greater than 12 inches in width, greater than 15 inches in width, greater than 20 inches in width or even greater than 25 inches in width.

In some preferred sign materials, the decorative features are intentionally included or caused to be included in the sign material by, for example, a company whose goods or services are being advertised. As used herein, a "desired design" comprises a portion of the sign that includes an image, a color scheme, a pattern, a design, a text or portions thereof that are selected by a manufacturer of the bag or others associated therewith (e.g., employee, agent, designer, etc. of the bag, etc.). It is contemplated that an entity including a decorative feature in a sign can be different from an entity selecting the desired design. For example, where a sign material comprises a Coca-Cola® advertisement, the decorative features could be selected for inclusion by Coca-Cola®. When the sign is obtained for inclusion in a bag, the desired design or design selected for inclusion on a bag could be selected by a bag manufacturer unrelated to Coca-Cola®. As used herein, a "virgin material" is material that has not been previously used or consumed of subjected to processing other than for its original production. As used herein, a "non-eco material" is any material that is not typically considered to have a low environmental impact and be environmentally friendly. Examples of eco materials include, among other things, hemp, organic cotton, silk, bamboo, polyester made from recycled plastic materials, lyocell, soy fabrics, cashmere, linen, alpaca, and ingeo. Examples of non-eco materials include, among other things, leather, faux leather, nylon and non-recycled polyester. As used herein, a "significant portion" means at least 15%. For example, where a dominant portion of a bag includes a significant portion of a virgin material, the dominant portion will include at least 15% virgin material.

The decorative portion of the sign material and the portion of the at least partially virgin material could be mechanically coupled to one another in any suitable way (e.g., gluing, sewing, melting (e.g., fusible tape or the materials themselves), bolting, stapling, etc.) such that the desired design of the sign material is visible when the bag is worn or used. Exemplary sign materials include, among other things, billboard materials having advertisements printed thereon. Additionally or alternatively, sign materials can be made at least in part of vinyl, PVC, or waterproof vinyl layers sandwiching a rip-stop nylon, polyester or other scrim. Additionally or alternatively, sign materials can be UV protected, durable, waterproof, semi-gloss finished, anti-mildew, flame retardant, or fade resistant (e.g., fades less than 15% in three years under normal conditions).

Viewed from another perspective, the inventive subject matter comprises methods of manufacturing a plurality (e.g., at least 2, at least 5, at least 25, etc.) of unique bags. One step of contemplated methods can include the step of obtaining a billboard material having an advertisement printed thereon. It is contemplated that when the plurality of unique bags being manufactured is many (e.g., 10 or more), two or more billboards can be obtained, as desirable or necessary, and the subsequent steps could apply to one or more of the billboards.

The step of obtaining a billboard material could be accomplished by ordering, purchasing, contracting for, removing, providing a removal service or by any other suitable means. In some aspects, the billboard material could be washed to remove dirt, grime and any other undesirables in any commercially suitable manner.

Additionally or alternatively, contemplated methods can include the step of removing an edge portion of a billboard material (e.g., a pipe sleeve or portion thereof). Preferably, this step is accomplished by removing as little of the decorative or non-sleeve portion (e.g., less than 20%, more preferably less than 10%, even more preferably less than 5%) of the billboard material as possible. It is contemplated that the step of removing an edge portion could comprise removing 1 edge, 2 edges, 3 edges or even 4 or more edges (e.g., in non-rectangular sign materials).

Additionally or alternatively, contemplated methods can include one or more of the steps of laying out a billboard material, determining or selecting decorative portions of the billboard material including desired designs, and removing the selected decorative portions from the billboard material. The desired designs selected typically will not be identical to one another, and therefore can be used in making two or more unique bags (i.e., bags having repurposed material portions that are not identical, and wherein visible portions differ by at least 5%, more preferably at least 10%, and even more preferably by at least 50% or even 100% (e.g., where a plurality of bags are made from a single billboard and thus there is no overlap in design)).

Additionally or alternatively contemplated methods can include the step of randomly or automatically cutting portions of the billboard material without selecting specific desired designs. For example, where a series of tote bags are being manufactured requiring 12 inches by 18 inches of a repurposed sign material, the billboard material could be automatically cut into 12 by 18 inch portions to optimize the number of bags that could be made using the billboard sign without consideration of where design elements get cut off. As another example, where a bag is made of only recycled billboard material (and not including any virgin material), it is likely that the recycled billboard material could be randomly cut rather than carefully selected and cut since there will be fewer, if any, visual breaks between recycled billboard material portions to consider.

Additionally or alternatively, contemplated methods can include the steps of obtaining an at least partially virgin material, and removing portions thereof that are sized and dimensioned, as appropriate, to make at least portions (e.g., dominant portions, straps, handles, etc.) of a plurality of bags when coupled with the selected and removed decorative portions of billboard material.

Additionally or alternatively, contemplated methods can include the step of mechanically coupling at least one decorative portion of billboard material with at least one portion of an at least partially virgin material such that a desired design of the at least one decorative portion would be visible when the bag is worn by a wearer. It should be appreciated that the portion including both billboard material and virgin material coupled to one another would typically create a visual break. Thus, it may be of importance to a manufacturer, retailer or purchaser of a bag of the inventive subject matter that the decorative portion(s) are carefully selected and cut to mesh with the portion(s) of the at least partially virgin material. For example, a virgin material may include a print design that (1) meshes, matches or otherwise fits desirably with a first portion of the billboard material, yet (2) clashes or does not desirably fit with a second, different portion of the same billboard material. The value of the bag could be optimized via selection of the first portion over the second portion.

While the above description focuses on bags and methods of manufacturing bags having (i) repurposed material, and (ii) virgin material, it should be appreciated that the above description can also be applicable to bags and methods of manufacturing bags having (i) an eco-friendly material, and (ii) at least one of a non-eco friendly material and a virgin material.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 1:
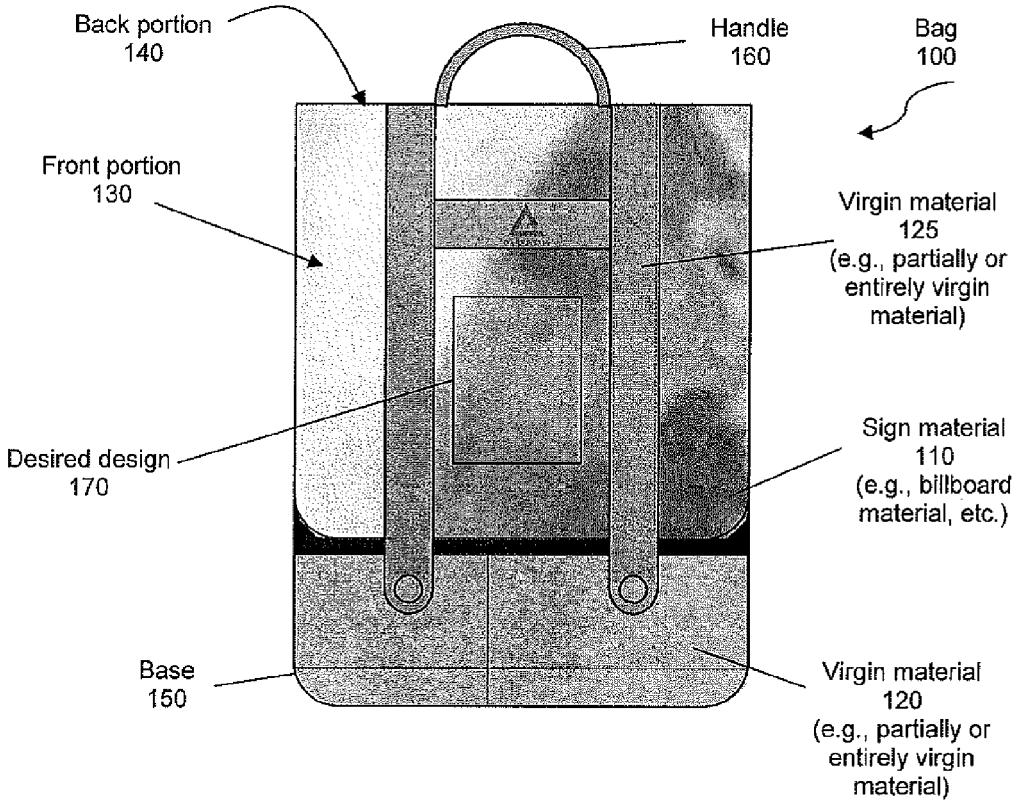
FIG. 1 illustrates an embodiment of a bag of the inventive subject matter.

FIG. 1 illustrates a tote bag of the inventive subject matter having a front portion that would be dominantly visible when worn by a wearer in a manner contemplated or preferred by a bag manufacturer or designer. As illustrated, the front portion 130 includes a decorative portion of a sign material 110 (e.g., a non-pipe sleeve portion of the sign material, etc.) and first and second virgin material portions 120 and 125. Virgin material portions 120 and 125 could comprise the same or different virgin materials, including for example, a leather, a faux leather, a Nylon, a cotton, a suede, a polyester, or any other suitable material(s). It should be appreciated that any portion of base 150 that is visible when bag 100 is worn by a wearer could be considered a part of the dominant front portion 130. It should also be appreciated that any portion of bag 100 (e.g., handle, front portion, back portion, side portion, a non-flat bottom portion, etc.) could comprise a sign material, virgin material, eco-friendly material, non-eco friendly material, a combination thereof, or any other suitable material. For example, a bag could comprise a base made from repurposed sign material that is suitable to protect the bag from rips and tears, or from water, snow or dirt on floors where they may be placed.

Front portion 130 can advantageously comprise any suitable ratio of repurposed sign material 110 to virgin material portions 120 and 125. In some preferred embodiments, the dominant front portion 130 could comprise at least 10%, more preferably at least 15%, or even more preferably at least 25% or even at least 35% of each of a repurposed sign material and an at least partially virgin material. Additionally or alternatively, an outer layer of bag of the inventive subject matter could comprise any suitable ratio of repurposed sign material 110 to virgin material portions 120 and 125. Additionally or alternatively, the repurposed sign material and the at least partially virgin material could be coupled such that a desired design 170 is visible when the bag 100 is worn by a wearer in a manner intended. Here, the bag is intended to be worn by placing handle 160 over the wearer's shoulder with back portion 140 facing the wearer, and front portion 130 facing away from the wearer.

Figure 2:
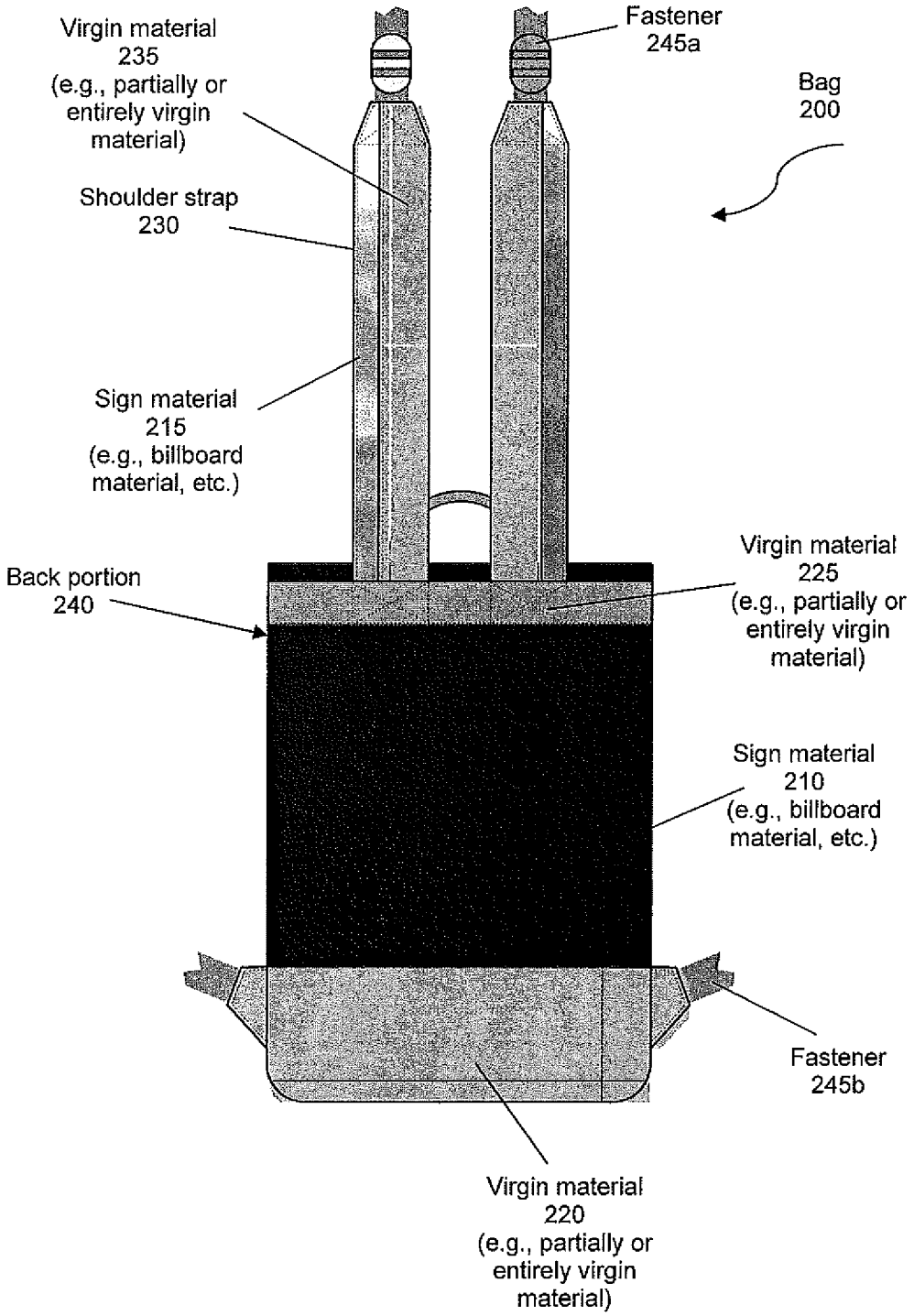
FIG. 2 illustrates another embodiment of a bag of the inventive subject matter.

FIG. 2 illustrates a backpack of the inventive subject matter comprising a back, non-dominant portion having significant amounts (e.g., at least 15%) of each of a sign material, and of a virgin material. As illustrated, bag 200 comprises a back portion 240 including a sign material 210, and virgin material portions 220 and 225. Bag 200 also comprises first and second shoulder straps (e.g., 230) including significant portions of a decorative portion of sign material 215 and a virgin material 235. It is contemplated that where virgin material 235 is less sturdy than sign material 215, the inclusion of sign material along a length of shoulder strap 230 (or any other portion of a bag) could protect virgin material 235 from tearing. The shoulder straps (e.g., 215) also comprises a fastener 245*a* that is complementary to fastener 245*b* located on or near a base of bag 200.

Figure 3:
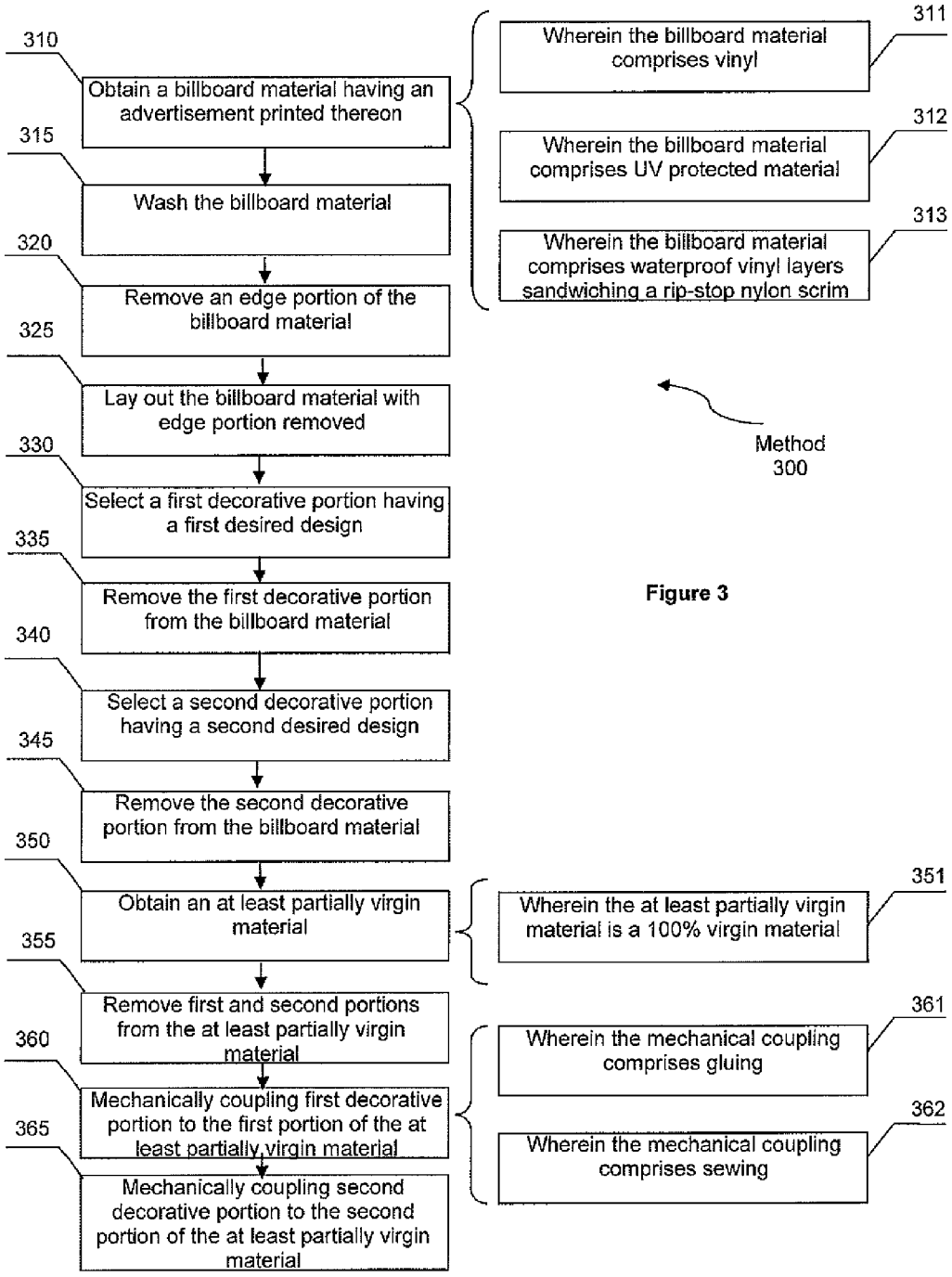
FIG. 3 is a flowchart illustrating a method of the inventive subject matter.

FIG. 3 is a flowchart illustrating some possible aspects of methods of the inventive subject matter. Method 300 can include the step of obtaining a billboard material having an advertisement printed thereon as shown in step 310. As illustrated in steps 311, 312 and 313, respectively, the step of obtaining the billboard material could comprise obtaining a billboard material comprising vinyl, obtaining a billboard material comprising a UV protected material (e.g., a UV protective coating), or a billboard material comprising waterproof vinyl layers sandwiching a rip-stop scrim material.

Method 300 can also include the step of washing the billboard material to remove any dirt, grime, or other undesirables that have been collected from an original or earlier use (e.g., display on a street or freeway, etc.) as shown in step 315. After the billboard material is washed, step 320 can include removing an edge portion of the billboard material—preferably all edge portions of the billboard material comprising a pipe sleeve. As described in step 325, 330 and 340, respectively, the billboard material can be laid out with edge portion(s) removed, and a user could manually select first and second decorative portions having first and second desired designs for inclusion in first and second unique bags. The first and second decorative portions could then be removed from the billboard material as shown in steps 335 and 345, respectively, for example, via cutting.

As preferred bags can include significant portions of a billboard material and an at least partially virgin material on an outer layer, a front portion or other dominant portion, method 300 could also include step 350 of obtaining an at least partially virgin (e.g., 100% virgin as shown in step 351, etc.) material, including for example, a cotton, a nylon, a leather, a faux leather, or any other suitable virgin material. Method 300 can also include step 355 of removing first and second portions from the at least partially virgin material, wherein the first and second portions are suitable for coupling with first and second decorative portions of the billboard material, respectively, to make first and second bags, or portions thereof. Additionally, method 300 can include the step of mechanically coupling (e.g., via glue as shown in step 361, via sewing as shown in step 362, etc.) the first decorative portion to the first portion of the virgin material as shown in step 360, such that the first desired design is visible to a passerby when the first bag is worn by a wearer. Additionally, method 300 can include the step of mechanically coupling the second decorative portion to the second portion of the virgin material as shown in step 365, such that the second desired design is visible to a passerby when the second bag is worn by a wearer.

It should be appreciated that in some embodiments, for example, when more than two bags are being made, method 300 could include selecting and removing third, fourth, fifth, or even more decorative portions having different desired designs from billboard material(s), and removing third, fourth, fifth, or even more portions from the at least partially virgin material(s).

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A method of manufacturing a plurality of bags including first and second bags, comprising:

obtaining a billboard material having an advertisement printed thereon, and washing the billboard material;

removing an edge portion of the billboard material, wherein the edge portion comprises a sleeve;

laying out the billboard material with the edge portion removed;

selecting a first decorative portion of the billboard material having a first desired design, wherein the first decorative portion has a length of less than 20 inches and a width of less than 12 inches;

removing the first decorative portion from the billboard material;

selecting a second decorative portion having a second desired design different from the first desired design; and wherein the first and second decorative portions have no overlap in design;

removing the second decorative portion from the billboard material;

obtaining an at least partially virgin material;

removing first and second portions from the at least partially virgin material to make at least portions of the first and second bags, respectively;

mechanically coupling the first decorative portion to the first portion of the at least partially virgin material so that the first desired design is visible, the first decorative portion covers at least 25% of an outer surface area of an exterior portion of the first bag, and the first portion of the at least partially virgin material covers at least 25% of the outer surface area of an exterior portion of the first bag; and mechanically coupling the second decorative portion to the second portion of the at least partially virgin material so that the second desired design is visible, and the second decorative portion covers at least 25% of an outer surface area of an exterior portion of the second bag.

2. The method of claim 1, wherein the first decorative portion covers less than 65% of the outer surface area of the exterior portion of the first bag.

3. The method of claim 1, wherein the first decorative portion covers less than 50% of the outer surface area of the exterior portion of the first bag.

4. The method of claim 1, wherein the first decorative portion has a length of less than 15 inches and a width of less than 5 inches.

5. The method of claim 1, wherein the billboard material comprises at least one of a vinyl, a UV protected material, and a rip-stop scrim.

6. The method of claim 1, wherein the step of mechanically coupling the first decorative portion to the first portion of the at least partially virgin material comprises at least one of sewing, gluing, melting or bolting.

* * * * *